US010576331B2

(12) United States Patent
Kuo

(10) Patent No.: US 10,576,331 B2
(45) Date of Patent: Mar. 3, 2020

(54) COMPOSITE MOTION EXERCISE MACHINE

(71) Applicant: SportsArt Industrial Co., Ltd., Tainan (TW)

(72) Inventor: Hai-Pin Kuo, Tainan (TW)

(73) Assignee: SPORTSART INDUSTRIAL CO., LTD., Tainan (TW)

( * ) Notice: Subject to any disclaimer, the term of this patent is extended or adjusted under 35 U.S.C. 154(b) by 71 days.

(21) Appl. No.: 16/043,858

(22) Filed: Jul. 24, 2018

(65) Prior Publication Data

US 2019/0030398 A1 Jan. 31, 2019

(51) Int. Cl.

| | |
|---|---|
| ***A63B 24/00*** | (2006.01) |
| ***A63B 22/00*** | (2006.01) |
| ***A63B 22/06*** | (2006.01) |
| ***A63B 21/00*** | (2006.01) |
| ***A63B 21/005*** | (2006.01) |

(52) U.S. Cl.

CPC ..... *A63B 24/0087* (2013.01); *A63B 21/0053* (2013.01); *A63B 21/159* (2013.01); *A63B 21/4034* (2015.10); *A63B 21/4035* (2015.10); *A63B 22/001* (2013.01); *A63B 22/0015* (2013.01); *A63B 22/0025* (2015.10); *A63B 22/0048* (2013.01); *A63B 22/0664* (2013.01); *A63B 22/0056* (2013.01); *A63B 22/0605* (2013.01); *A63B 2022/002* (2013.01); *A63B 2022/0647* (2013.01); *A63B 2022/0682* (2013.01)

(58) Field of Classification Search

CPC ..... A63B 24/0087; A63B 22/0015; A63B 22/0664; A63B 22/001; A63B 22/0048; A63B 21/159; A63B 1/0053; A63B 22/0025; A63B 21/4035; A63B 21/4034; A63B 22/0056; A63B 22/0605; A63B 2022/0647; A63B 2022/0682; A63B 2022/002; A63B 23/035

See application file for complete search history.

(56) References Cited

U.S. PATENT DOCUMENTS

| | | | | |
|---|---|---|---|---|
| 7,806,808 | B2 * | 10/2010 | Kuo | A63B 22/001 482/51 |
| 7,931,566 | B1 * | 4/2011 | Radke | A63B 21/015 482/51 |
| 9,050,485 | B2 * | 6/2015 | Huang | A63B 22/001 |
| 9,050,498 | B2 * | 6/2015 | Lu | A63B 21/154 |
| 9,283,425 | B2 * | 3/2016 | Lu | A63B 21/154 |
| 9,295,874 | B1 * | 3/2016 | Chen | A63B 22/0023 |
| 9,375,606 | B1 * | 6/2016 | Maresh | A63B 22/04 |
| 9,724,559 | B2 * | 8/2017 | Chang | A63B 22/0664 |

(Continued)

*Primary Examiner* — Garrett K Atkinson
(74) *Attorney, Agent, or Firm* — Sinorica, LLC

(57) ABSTRACT

A composite motion exercise machine includes a control panel which provides a plurality of movement modes and allows a user to issue a command to change the configuration of linkage units of the exercise machine to have the machine perform a movement mode without manual adjustment, so that the pedal of each linkage unit can be moved along a closed trajectory. The control panel also allows the user to finely adjust the trajectory and the resistance associated therewith. The trajectory performed by each pedal of the exercise machine is ergonomic so that the user can be protected from exercise injury.

11 Claims, 15 Drawing Sheets

(56) References Cited

U.S. PATENT DOCUMENTS

| | | | | |
|---|---|---|---|---|
| 10,478,665 | B1 * | 11/2019 | Daly | A63B 21/4034 |
| 2009/0111663 | A1 * | 4/2009 | Kuo | A63B 22/001 482/53 |
| 2010/0151999 | A1 * | 6/2010 | Kuo | A63B 22/001 482/52 |
| 2015/0246260 | A1 * | 9/2015 | Giannelli | A63B 24/0062 482/8 |

* cited by examiner

COMPOSITE MOTION EXERCISE MACHINE

(a) TECHNICAL FIELD OF THE INVENTION

The present invention relates to a composite motion exercise machine and, more particularly, to an exercise machine that includes a control panel to adjust the configuration of linkage units of the machine to adjust the trajectory performed by the pedals of the linkage units without manual adjustment, so that the exercise machine can provide a plurality of movement modes, including elliptical movement mode, stepper movement mode, and bike movement mode, for users.

(b) DESCRIPTION OF THE PRIOR ART

A variety of indoor sports equipment can be used to train body muscles, so that a person may perform physical training at home or indoors to achieve the purpose of fitness or rehabilitation. Indoor sports equipment, such as treadmills, stair trainners, rowing machines, exercise bikes and so on, are usually chosen by consumers. Under new technology development, exercise machines with a specific motion trajectory are widely favored by consumers. Although the exercise machines have the effect of physical training, they provide only one movement mode. It is impossible for those machines to provide more than one movement modes. There is no existing single machine that can provide elliptical movement mode, stepper movement mode, and bike movement mode. Besides, those machines require users to follow the movement trajectories thereof. If the movement trajectory of an exercise machine is not designed properly, users may feel pain at their feet muscles while using the machine. After using an improperly designed machine for a period of time, exercise injury may result.

SUMMARY OF THE INVENTION

One object of the present invention is to provide a composite motion exercise machine, which provides a plurality of movement or exercise modes. Through a control panel, a user can change the configuration of linkage units of the machine to have the pedals thereof moved along a trajectory without manual adjustment. Furthermore, the control panel contains a plurality of fine adjustment keys, which can further adjust the trajectory and the required resistance. The trajectory performed by the pedals is ergonomic so that a user can be protected from exercise injury.

More pecifically, the exercise machine may comprise a base frame, a pair of linkage units mounted at the base frame, and a transmission unit mounted at the base frame. Each of the linkage units includes a hollow adjustment link provided with a pivot portion at a top thereof, a lateral link, a lower link provided with one pedal at a rear end thereof, a substantially vertical link 55, and an upper link 54. Each linkage unit further includes a grip bar provided at the pivot portion of the corresponding hollow adjustment link. The pivot portion of the hollow adjustment link of each linkage unit is pivotally connected to one of left and right shafts provided at a rear upright bar of the base frame. The hollow adjustment link includs therein a raising/lower device for moving a raising/lowering block which is pivotally connected to one end of the upper link. Each of the crank connecting rod assemblies includes a hollow link body having a front pivot portion and a rear pivot portion, a displacing device, and a displacement block driven by the displacing device and provided with a pivot pin that is pivotally connected to a top of the lateral link. The front pivot portion of each crank connecting rod assembly is pivotally connected to a crank assembly. The rear pivot portion of each crank connecting rod assembly is pivotally connected to another end of the upper link and a top of the substantially vertical link. A bottom of the substantially vertical link is pivotally connected to a fixed pivot portion of the middle transverse bar. The lateral link is provided with a pivot portion at a bottom thereof for being pivotally connected to a front end of the lower link. The lower link is provided with a pivot portion at a middle thereof for being pivotally connected to a bottom of the hollow adjustment link. The pivot portion of the lateral link and the bottom of the hollow adjustment link of each linkage unit are located respectively at two sides of a vertical axis extending along a front upright bar of the base frame. The pivot portion of the lateral link and the pedal of each linkage unit are located respectively at two sides of a vertical axis passing through the corresponding fixed pivot portion of the middle transverse bar. While using the exercise machine, the crank connecting rod assemblies and the hollow adjustment links can be adjusted to change the movement mode performed by the machine and the resistance associated therewith, so that each pedal can perform a closed path which is ergonomical so that a user can be protected from exercise injury.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
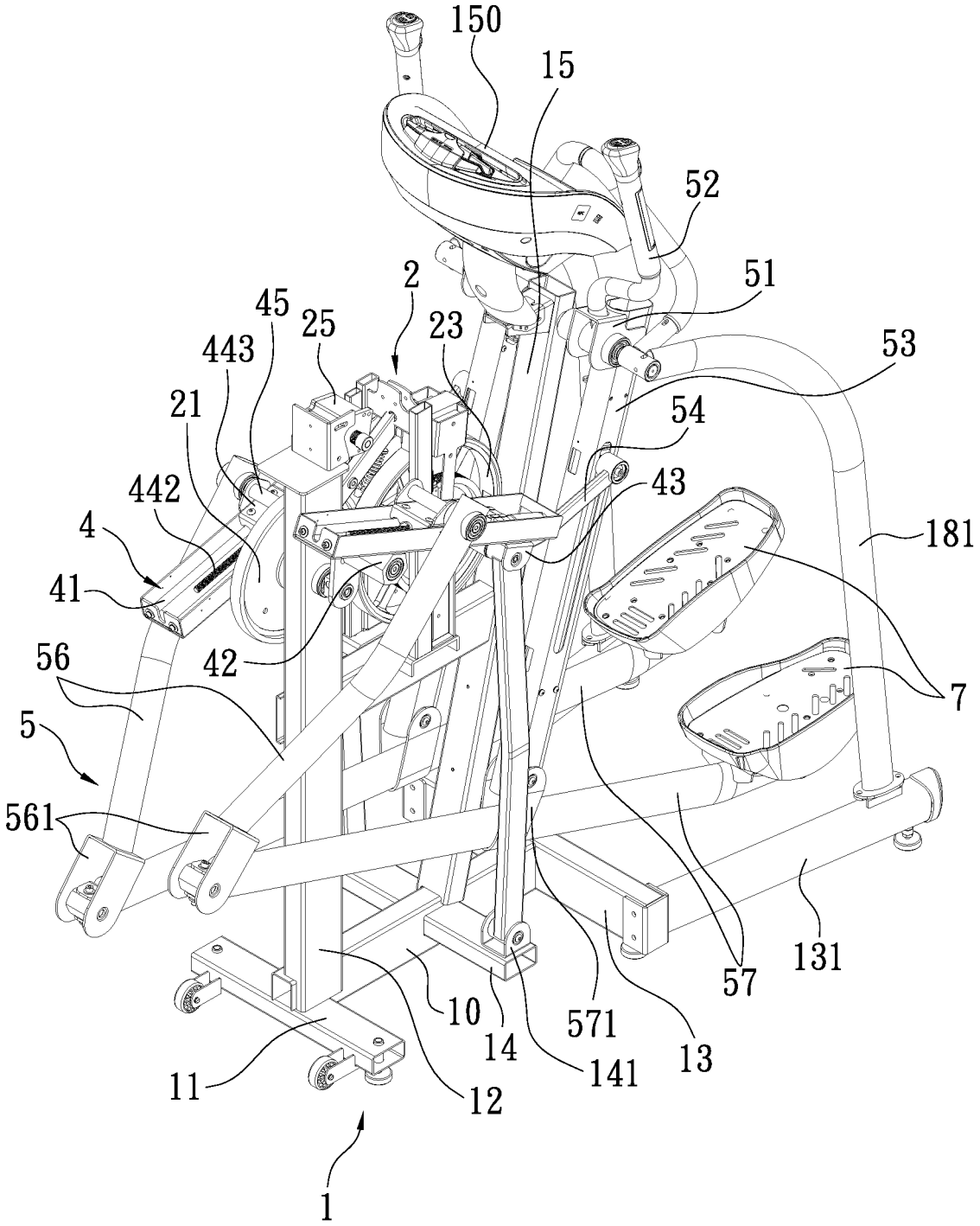
FIG. 1 shows a 3-dimensional view of an exercise machine according to one embodiment of the present invention.
Figure 2:
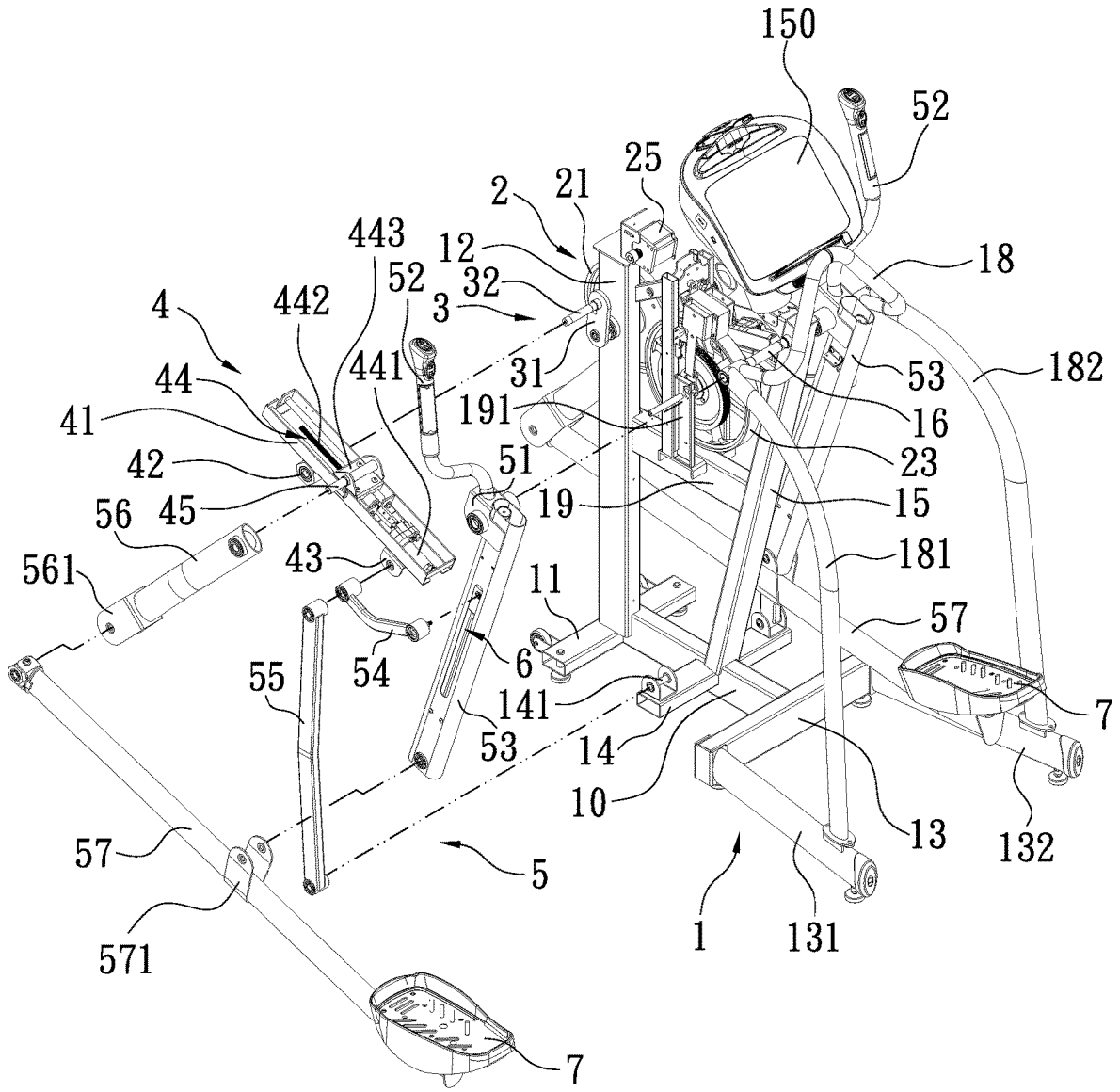
FIG. 2 shows a partially exploded view of the exercise machine.

Referring to FIGS. 1 and 2, a composite motion exercise machine according to one embodiment of the present invention is shown. The exercise machine, which can provide a plurality of movement or exercise modes, generally comprises a base frame 1, a transmission unit 2, a crank assembly 3, a pair of crank connecting rod assemblies 4, a pair of linkage units 5, and a control panel 150, through which a user may select a movement mode to have a pedal moved along a trajetory without manual adjustment of the machine. Furthermore, the control panel 150 allows a user to finely adjust the trajectory of the pedal and the required resistance to meet the requirement of a user, so that the pedal can be moved along a closed path or trajectory, which is ergonomical so that the user can avoid exercise injury while using the exercise machine.

Figure 7:
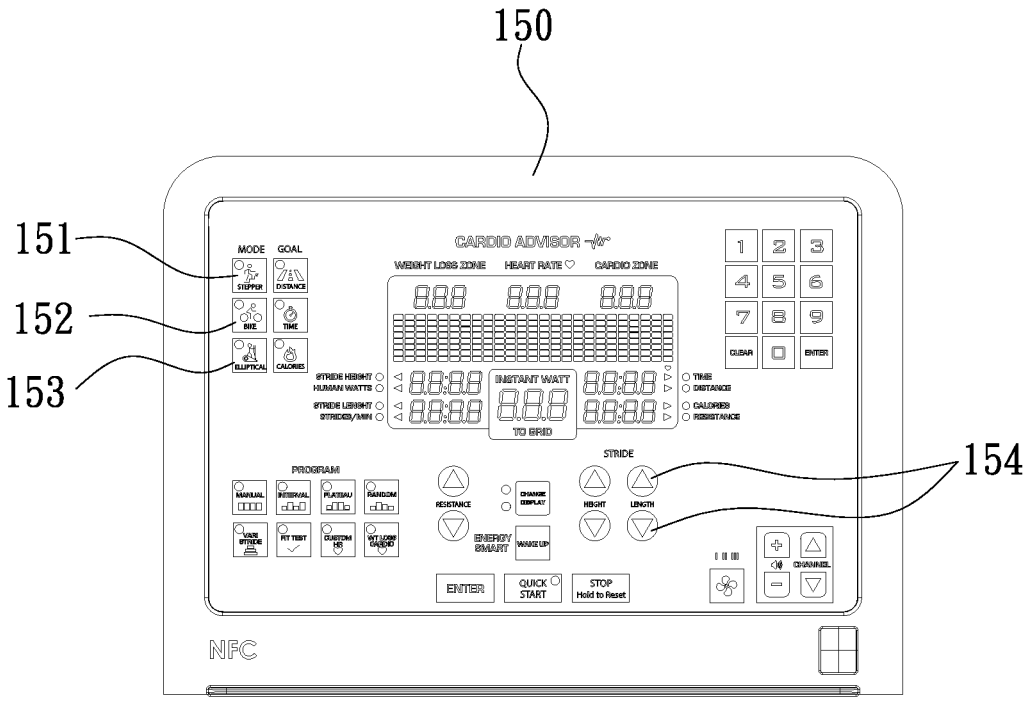
FIG. 7 shows a plan view of a control panel used in the exercise machine.

The base frame 1 includes a main longituindal bar 10, a front transverse bar 11 at a front end of the main longitudinal bar 10, a rear transverse bar 13 at a rear end of the main longituidinal bar 10, a middle transverse bar 14 at a middle portion of the main longituidinal bar 10, a front upright bar 12 extending upwardly from an intersection of the main longituidinal bar 10 and the front transverse bar 11, a left side bar 131 extending rearwardly from one end of the rear transverse bar 13, a right side bar 132 extending rearwardly from another end of the rear transverse bar 13, and a rear upright bar 15 extending upwardly from an intersection of the main longitudinal bar 10 and the middle transverse bar 14. The control panel 150, commonly known as an instrument panel or instrumentation electronic panel, is located at a top of the rear upright bar 15. As shown in FIG. 7, the control panel 150 contains an elliptical movement key 153, a stepper movement key 151, and a bike movement key 152, and a plurality of fine adjustment keys 154. The rear upright bar 15 is provided with a left shaft 16 and a right shaft 17 at a location below the control panel 150. A handle bar 18 is fixed between the left and right shafts 16, 17. A left guard rail 181 is provided between the left shaft 16 and the left side bar 131. A left guard rail 182 is provided between the right shaft 17 and the right side bar 132. A horizontal connection bar 19 is provided between the front upright bar 12 and the rear upright bar 15. An upright brace 191 extends upwardly from the connection bar 19.

Figure 3:
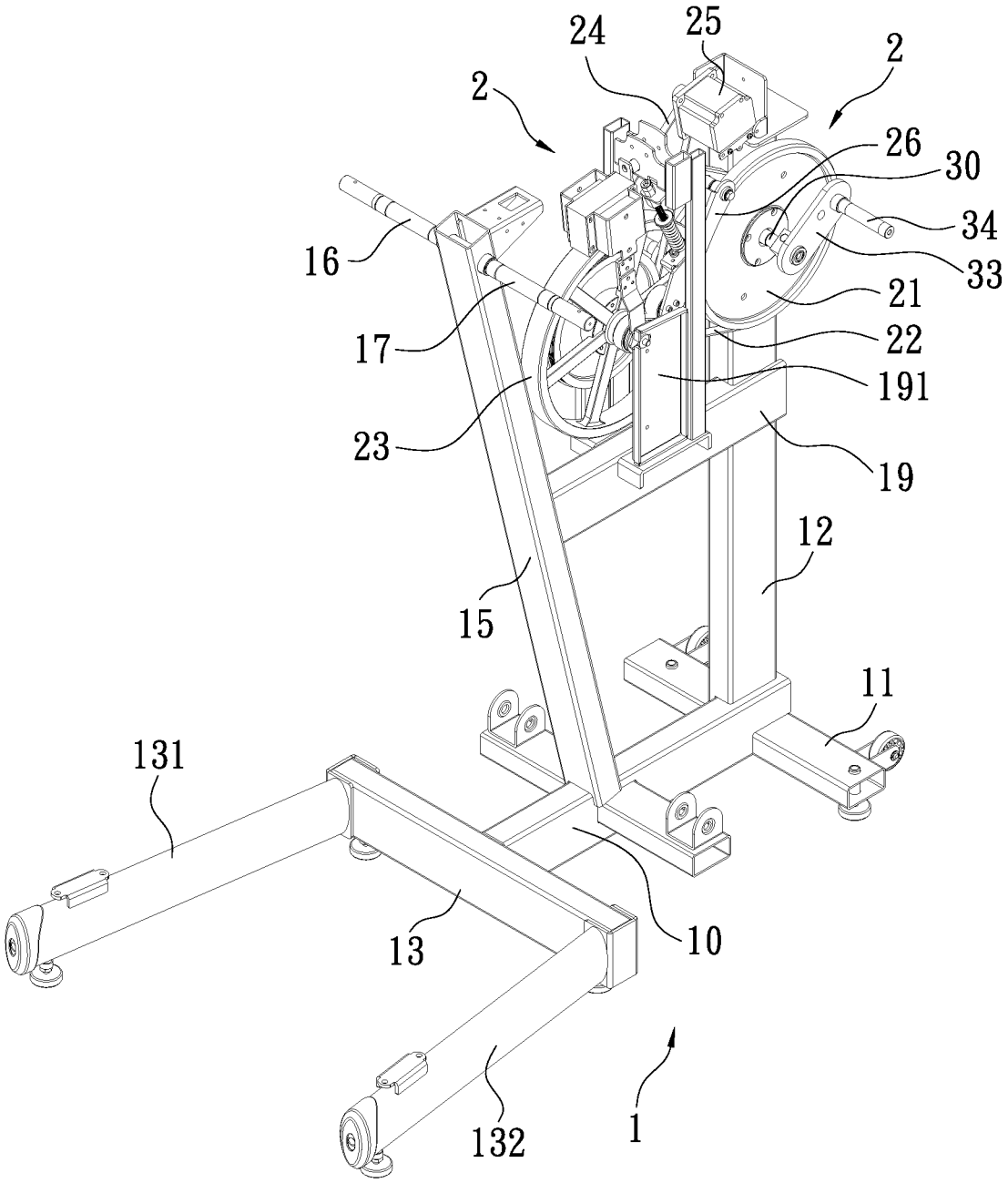
FIG. 3 shows a 3-dimensional view of a base frame mounted with a transmission unit in the exercise machine.
Figure 4:
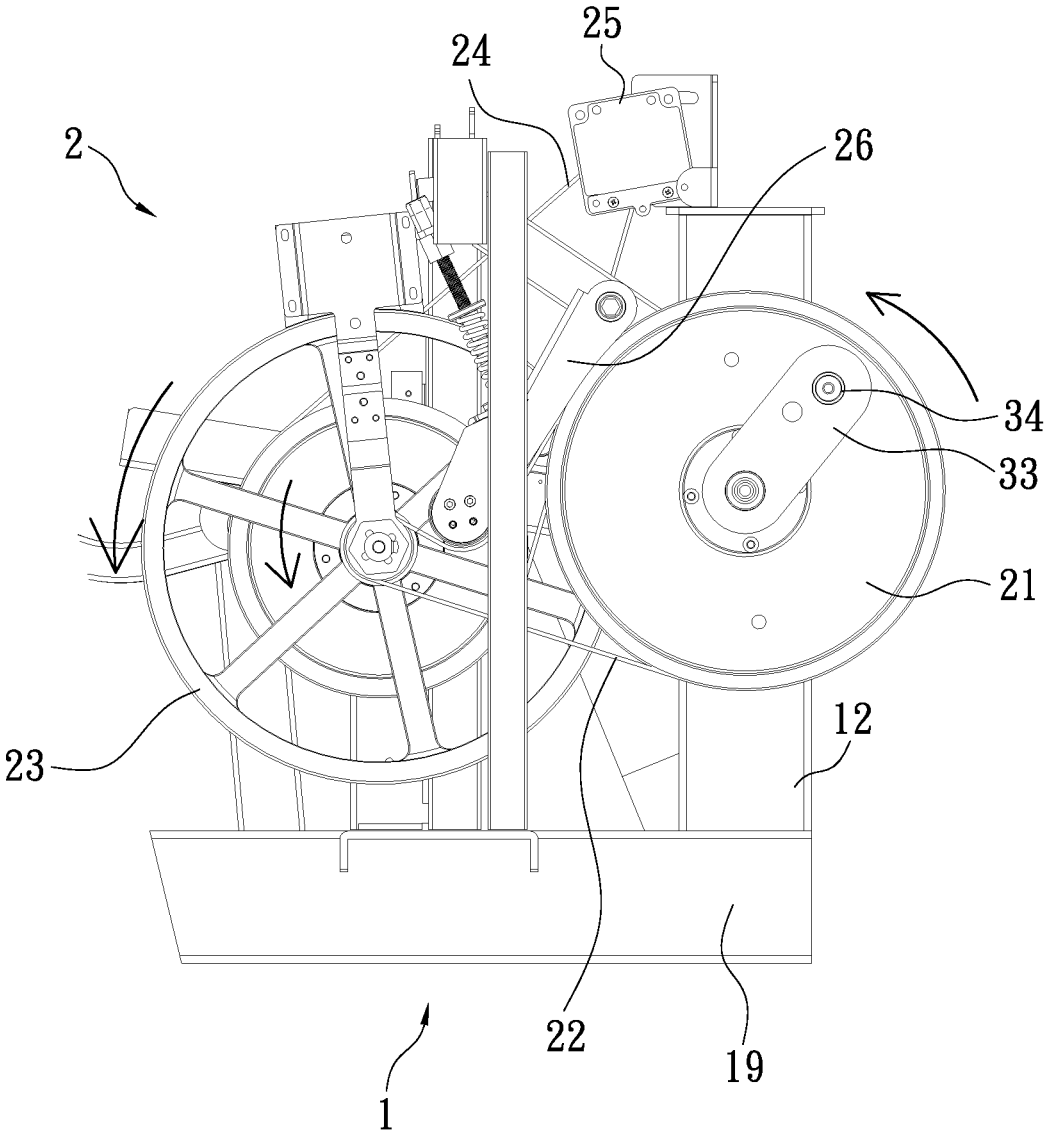
FIG. 4 shows an enlarged side view of the transmission unit mounted on the base frame.

Referring to FIGS. 3 and 4, the transmission unit 2, which is installed on the base frame 1, includes a first wheel 21, a first belt 22, a second wheel 23 made of cast steel, a second belt 24, an electrical generator 25, and an idler set 26. The first wheel 21 is mounted at the front upright bar 12 of the base frame 1. The second wheel 23 is mounted at the upright brace 191 provided at the connection bar 19. The electrical generator 25 is mounted at a top of the front upright bar 12. The first belt 22 is disposed around the first wheel 21 and a pulley (not labeled) mounted coaxially with the second wheel 23. The second belt 24 is disposed around another pulley (not labeled) mounted coaxially with the second wheel 23 and a pulley (not shown) mounted at an driven axle of the electrical generator 25 so that the first wheel 21 can rotate the second wheel 23 which in turn rotate the electrical generator 25 so as to generate electricity. The idler set 26 is forced to contact the first belt 22 to absrob vibrational energy while using the exercise machine, so that noise level can be reduced and the life span of the exercise machine can be increased.

Referring to FIGS. 1 through 3, the crank assembly 3 includes a central axle 30, a left crank arm 31, and a right crank arm 33. The central axle 30 is fixed at a center of the first wheel 21 and extending through the front upright bar 12 so that the first wheel 21 is rotatably mounted at the front upright bar 12. The left crank arm 31 is fixed to one end of the central axle 30, and the right crank arm 33 is fixed to another end of the central axle 30 and extends in a direction opposite to the left crank arm 31. Furthermore, the crank assembly 3 includes a left crank pin 32 and a right crank pin 34, wherein the left crank pin 32 is located at one end of the left crank aim 31 distal from the central axle 30; the right crank pin 34 is located at one end of the right crank arm 33 distal from the central axle 30.

Figure 5:
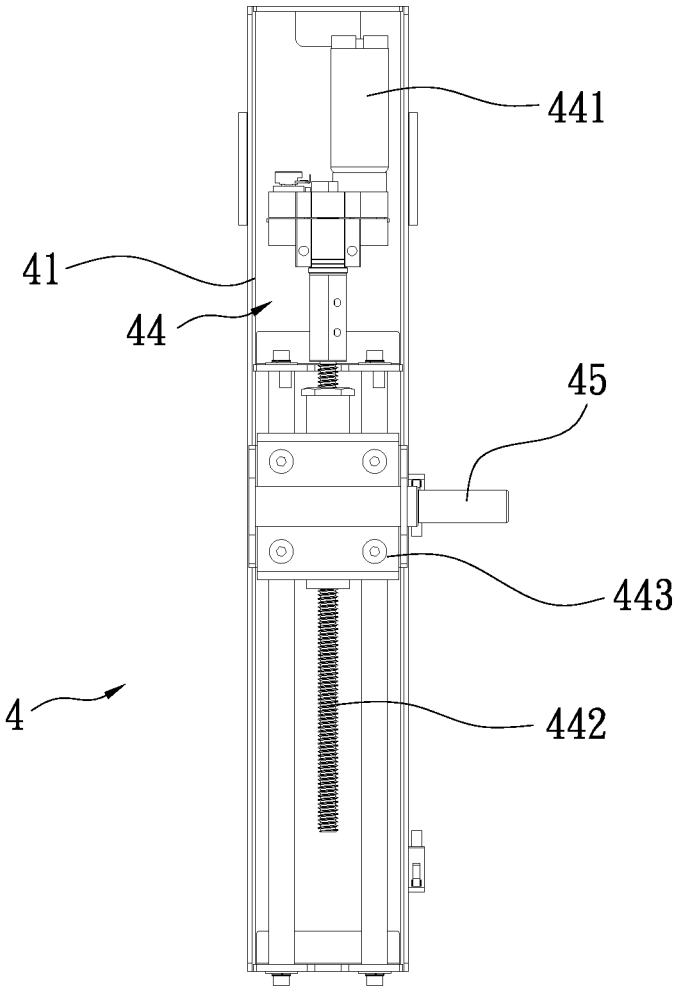
FIG. 5 shows a plan view of a crank connecting rod assembly used in the exercise machine, which includes therein a displacement block.
Figure 8:
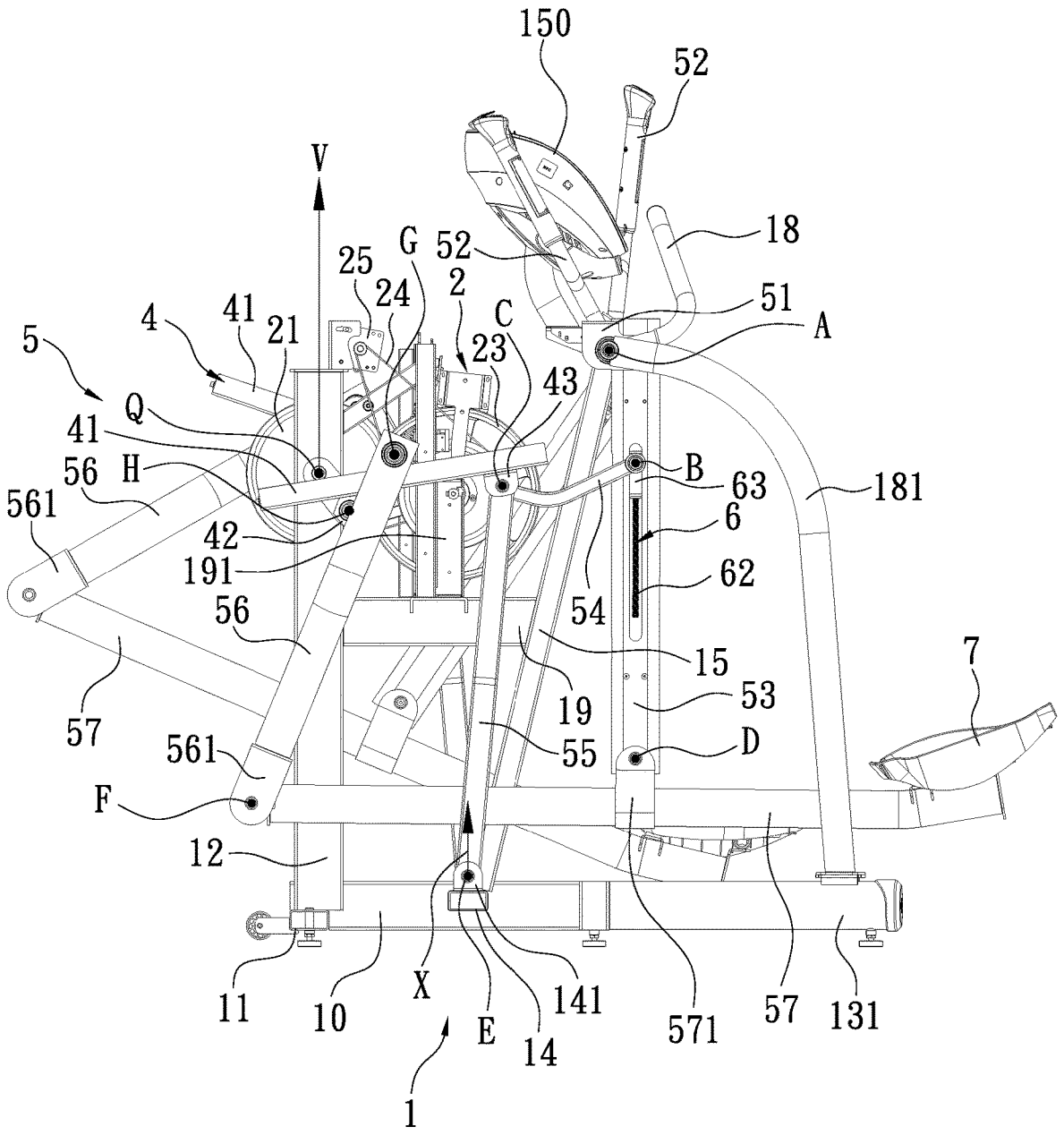
FIG. 8 shows a side view of the exercise machine.

Referring to FIGS. 1, 2 and 5, each of the crank connecting rod assemblies 4 includes a hollow link body 41 having a front pivot portion 42 and a rear pivot portion 43, a displacing device 44 within the hollow link body 41, and a displacement block 443 driven by the displacing device 44, wherein the front pivot portion 42 of each crank connecting rod assembly 4 is pivotally connected to one of the left and righ crank pins 32, 34 which is indicated by point (H), as shown in FIG. 8. As shown in FIG. 5, the displaceing device 44 includes a motor 441 and a threaded rod 442 capable of being rotated by the motor 441, wherein the displacement block 443 is in threaded engagement with the threaded rod 442. The displacement block 443 is provided with a pivot pin 45 (see FIGS. 2 and 5) which is indicated by point (G), as shown in FIG. 8. As such, the motor 441 can rotate the threaded rod 442, which in turn moves the displacement block 443, so that pivot(G) can be moved linearly along the hollow link body 41 and thus the position of point (G) can be adjusted.

Referring to FIGS. 1, 2, 6 and 8, each of the linkage units 5, which is mounted at one side of the base frame 1 and connected with the transmission unit 2, includes a hollow adjustment link 53 provided with a pivot portion 51 at a top thereof, a lateral link 56, a lower link 57 provided with a pedal 7 at a rear end thereof, a substantially vertical link 55, and an upper link 54. The pivot portion 51 is provided thereon with a grip bar 52. The pivot portion 51 of each linkage unit 5 is pivotally connected to one of the left and right shafts 16, 17 of the rear upright bar 15. Taking the left linkage unit 5 as an example, the pivot portion 51 is pivotally connected to the left shaft 16 of the rear upright bar 15, wherein the left shaft 16 is indicated by point (A). The hollow adjustment link 53 includes therein a raising/lowering device 6 for moving a raising/lowering block 63 which is pivotally connected at a point (B) to one end of the upper link 54. The rear pivot 43 of the crank connecting rod assembly 4 is pivotally connected to another end of the upper link 54 and a top of the substantially vertical link 55, wherein the rear pivot portion 43 is indicated by pin (C). A bottom of the substantially vertical link 55 is pivotally connected to a fixed pivot portion 141 of the middle transverse bar 14, which is indicated by pivot point (E). The lateral link 56 is provided at its lower end with a pivot portion 561, to which a front end of the lower link 57 is pivotally connected, wherein the pivot portion 561 is indicated by point (F). The pivot pin 45 of the displacement block 443, indicated by pivot point (G), is pivotally connected to a top of the lateral link 56. The lower link 57 is provided with a pivot portion 571 at a middle thereof for being pivotally connected to a bottom of the hollow adjustment link 53, wherein the pivot portion 571 is indicated by point (D).

Figure 6:
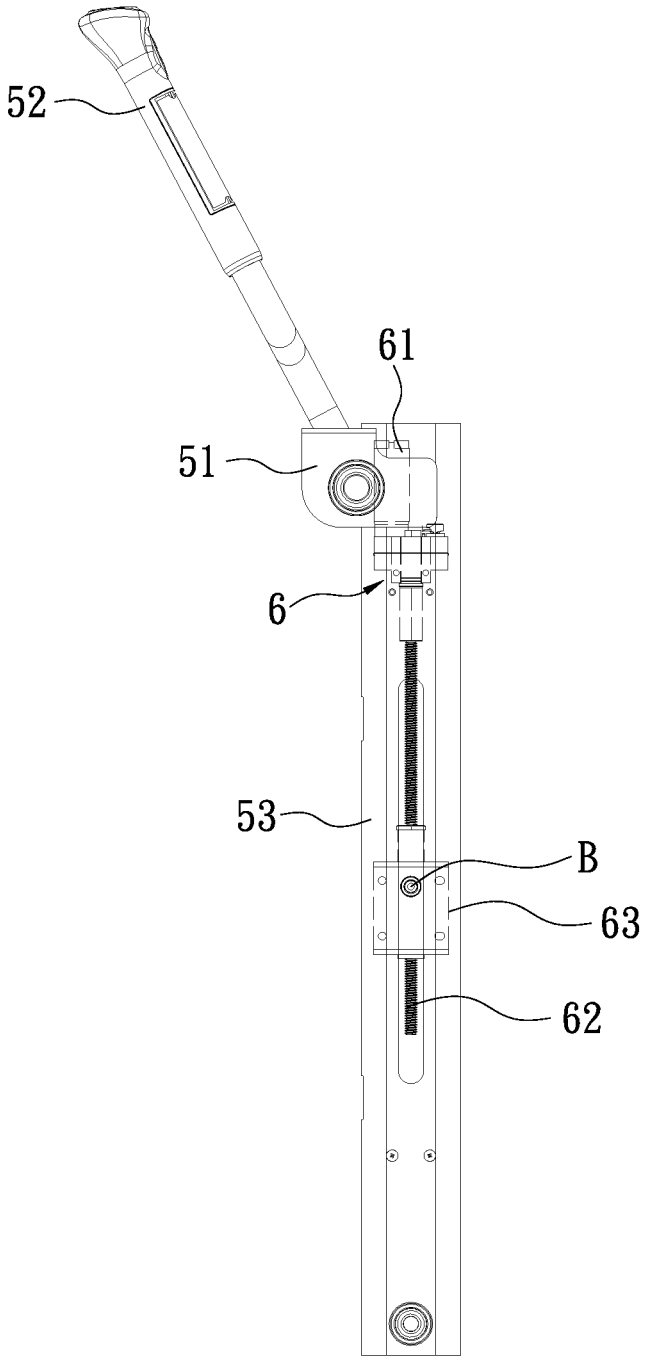
FIG. 6 shows a plan view of a hollow adjustment link used in the exercise machine, which includes therein a raising/lowering block.

Referring to FIGS. 6 and 8, the raising/lowering device 6, which is mounted within the hollow adjustment link 53, includes a motor 61 and a threaded rod 62 extending from a driving axle of the motor 61. The threaded rod 62 is in engagement with the raising/lowering block 63, which has a pivot, indicated by point (B), to be connected with one end of the upper link 54 (see alo FIG. 10). As such, the motor 61 can rotate the threaded rod 62, which in turn moves the block 63 along the adjustment link 53, so that point (B) can be moved linearly along the hollow adjustment link 53, thus changing the position of point (B).

Figure 9:
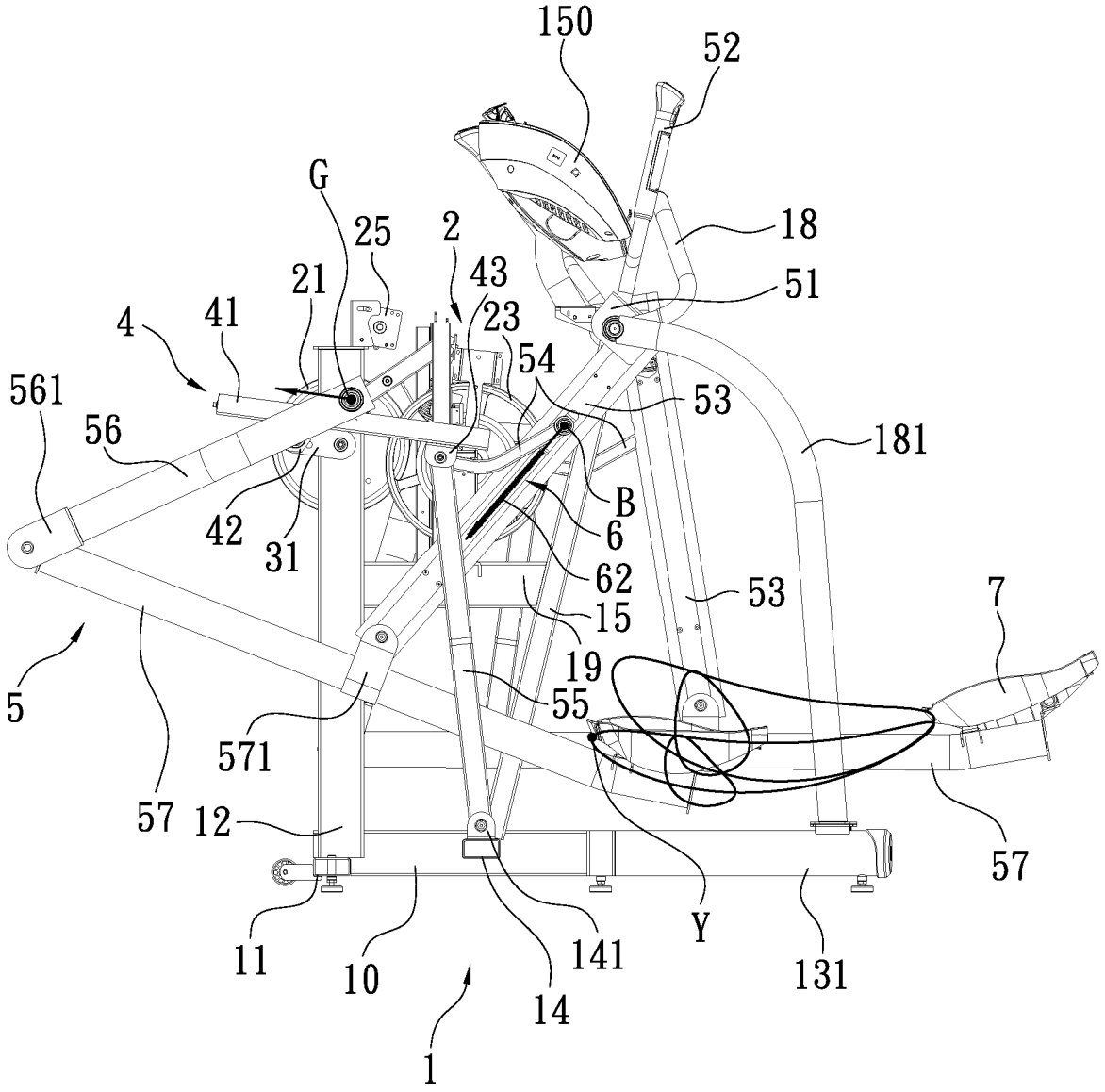
FIG. 9 shows a schematic view of the exercise machine, wherein a plurality of trajectories, corresponding to adjustments of the raising/lowering block within the hollow adjustment link and the displacement block within the crank connecting rod assembly, can be performed by a pedal thereof.

Referring to FIG. 8, one structural feature of the present invention is that the pivot portion 561 of the lateral link 56 (indicated as point (F)), and the bottom of the hollow adjustment link 53 (indicated by point (D)) are located respectively at two sides of a vertical axis (V) which starts from the center of the first wheel 21 (indicated by point (Q)) and extends along the front upright bar 12; the pivot portion 561 of the lateral link 56 (indicated by point (F)) and the pedal 7 are located respectively at two sides of a vertical axis (X) which passes through the corresponding fixed pivot portion 141 of the middle transverse bar 14. As usch, the exercise machine can provide a plurality of movement modes, enabling each pedal 7 to perform a plurality of paths or trajectories (Y) (see FIG. 9), which are more ergonomic than the paths performed by the pedals of conventional exercise machines, so that a user can be protected from exercise injury. Similar to an ellipse, the path or trajectory performed by each pedal 7 can be defined by a major axis and a minor axis, wherein both axes are perpendicular to each other, and the major axis is longer than the minor axis.

The exercise machine of the present invention can provide a plurality of movement or exercise modes, including elliptical movement mode, stepper movement mode, and bike movement mode. Through the control panel 150, a user may issue a command to adjust the crank collecting rod assemblies 4 and/or the raising/lowering device 6 within the hollow adjustment link 53 to change the configuration of each linkage unit 5 so that the exercise machine can perform one movement mode desired for the user.

The trajectory (Y) performed by each pedal 7 and the resistance associated therewith can be adjusted by changing the positions of the displacement blocks 443 of the crank connecting rod assemblies 4 or the raising/lowering blocks 63 of the hollow adjustment links 53, as shown in FIGS. 9 through 14. While the exercise machine is being operated, the pivot pin 45, indicated by point (G), is moved along a generally elliptical path.

Figure 10:
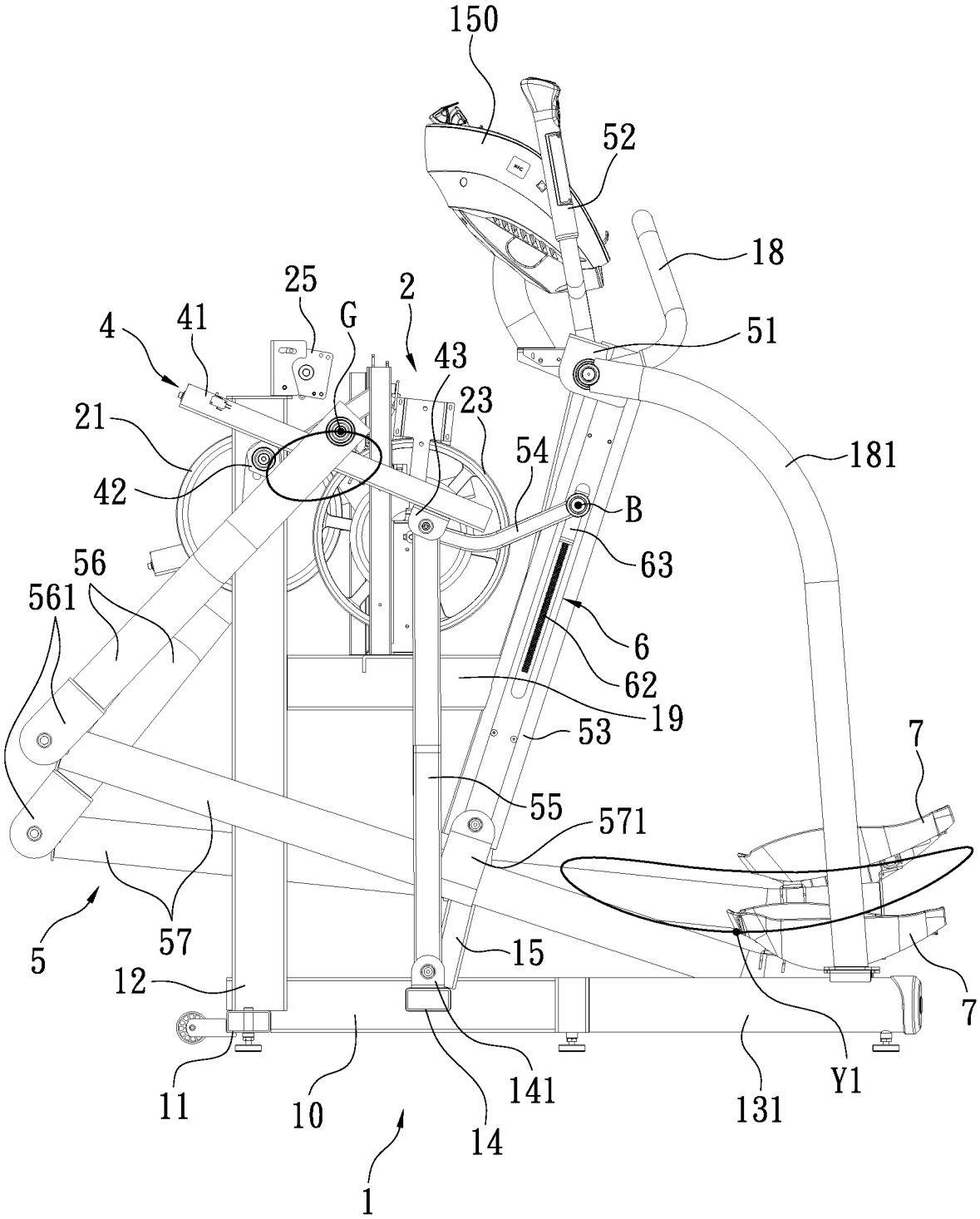
FIG. 10 shows a schematic view of the exercise machine, wherein the pedal can be moved along a trajectory by adjusting the raising/lowering block to a highest postion and adjusting the displacement block to a rearmost position.
Figure 11:
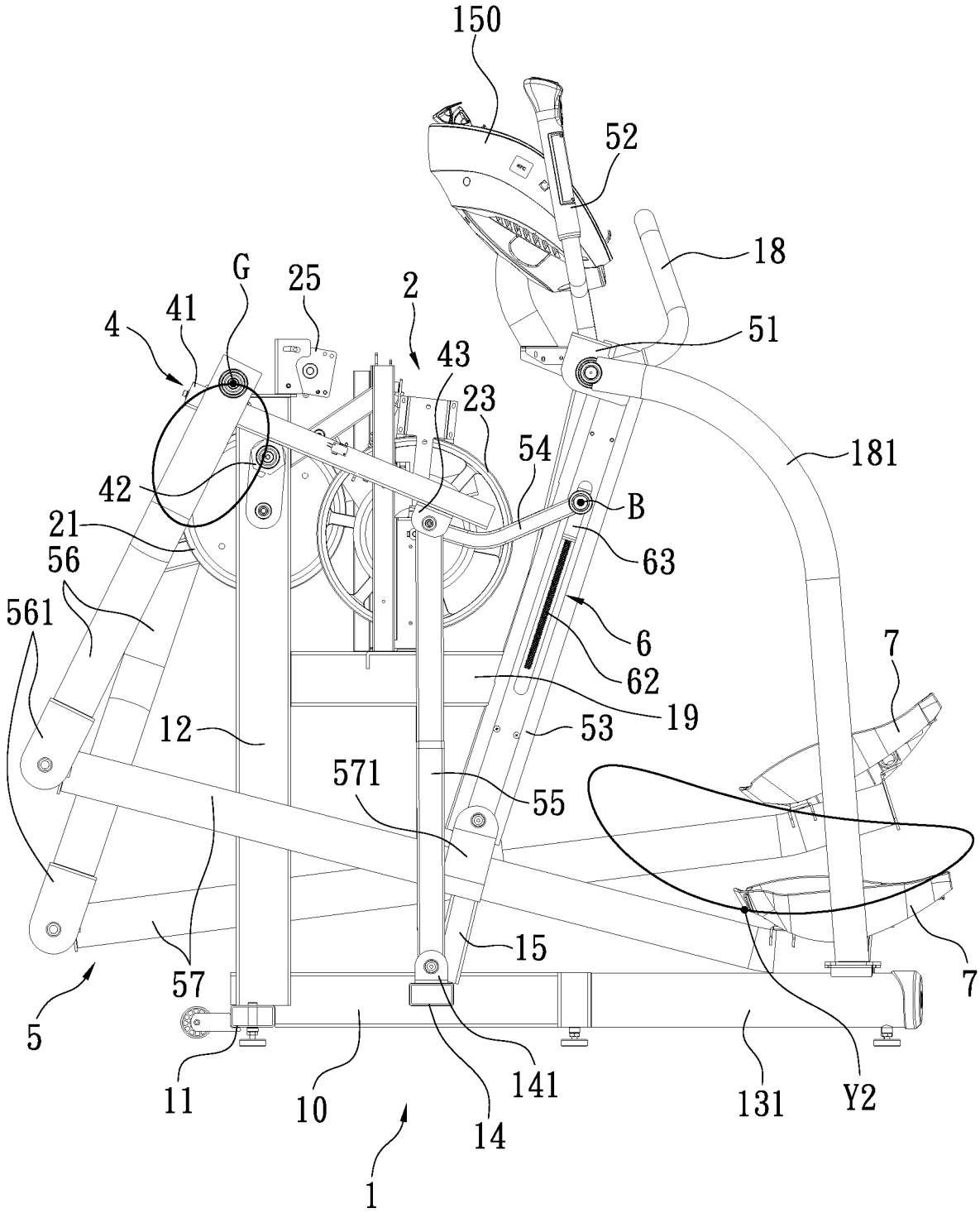
FIG. 11 shows a schematic view of the exercise machine, wherein the pedal can be moved along a trajectory by adjusting the raising/lowering block to a highest postion and adjusting the displacement block to a frontmost position.
Figure 12:
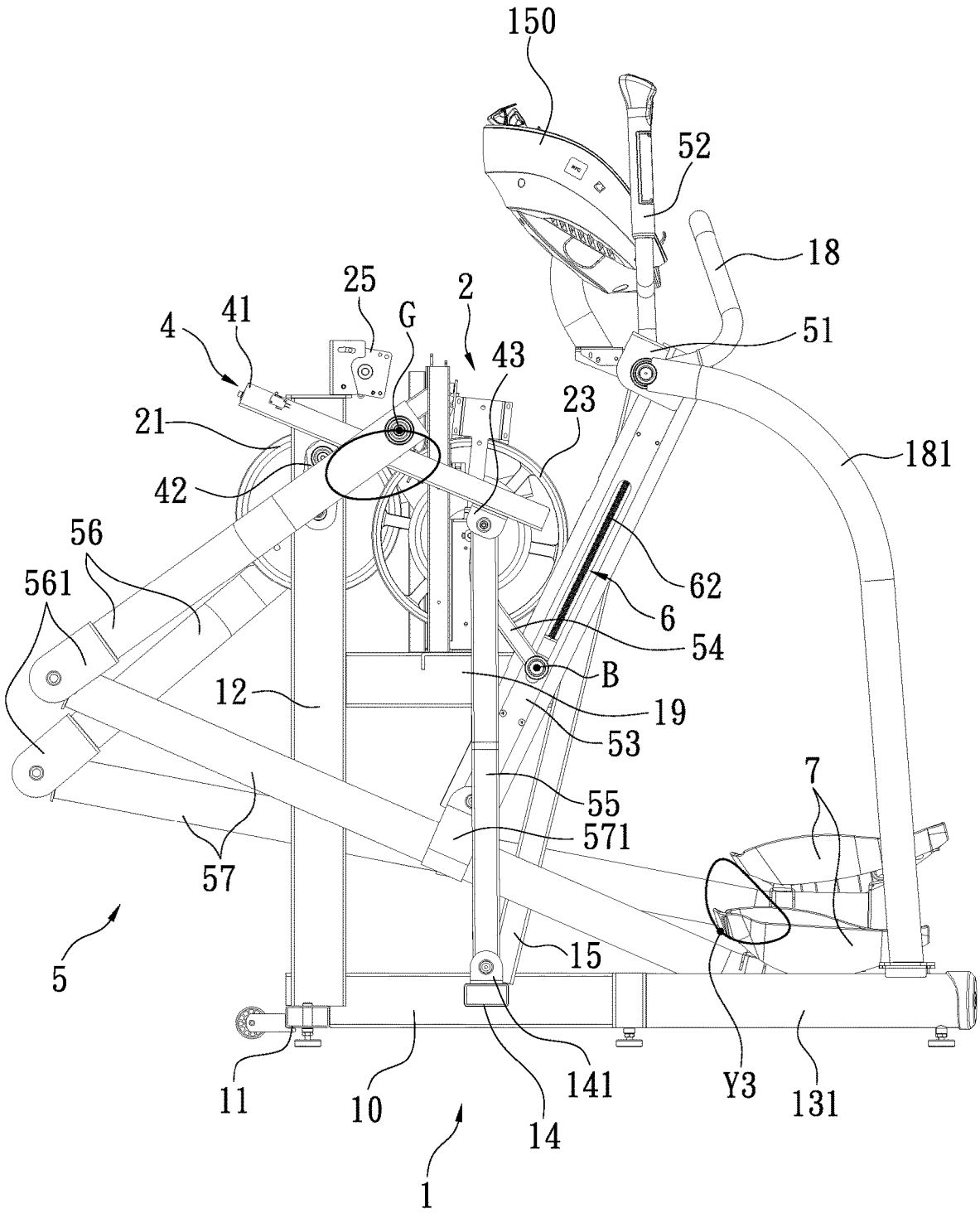
FIG. 12 shows a schematic view of the exercise mahcine, wherein the pedal can be moved along a trajectory by adjusting the raising/lowering block to a lowest postion and adjusting the displacement block to a rearmost position.
Figure 13:
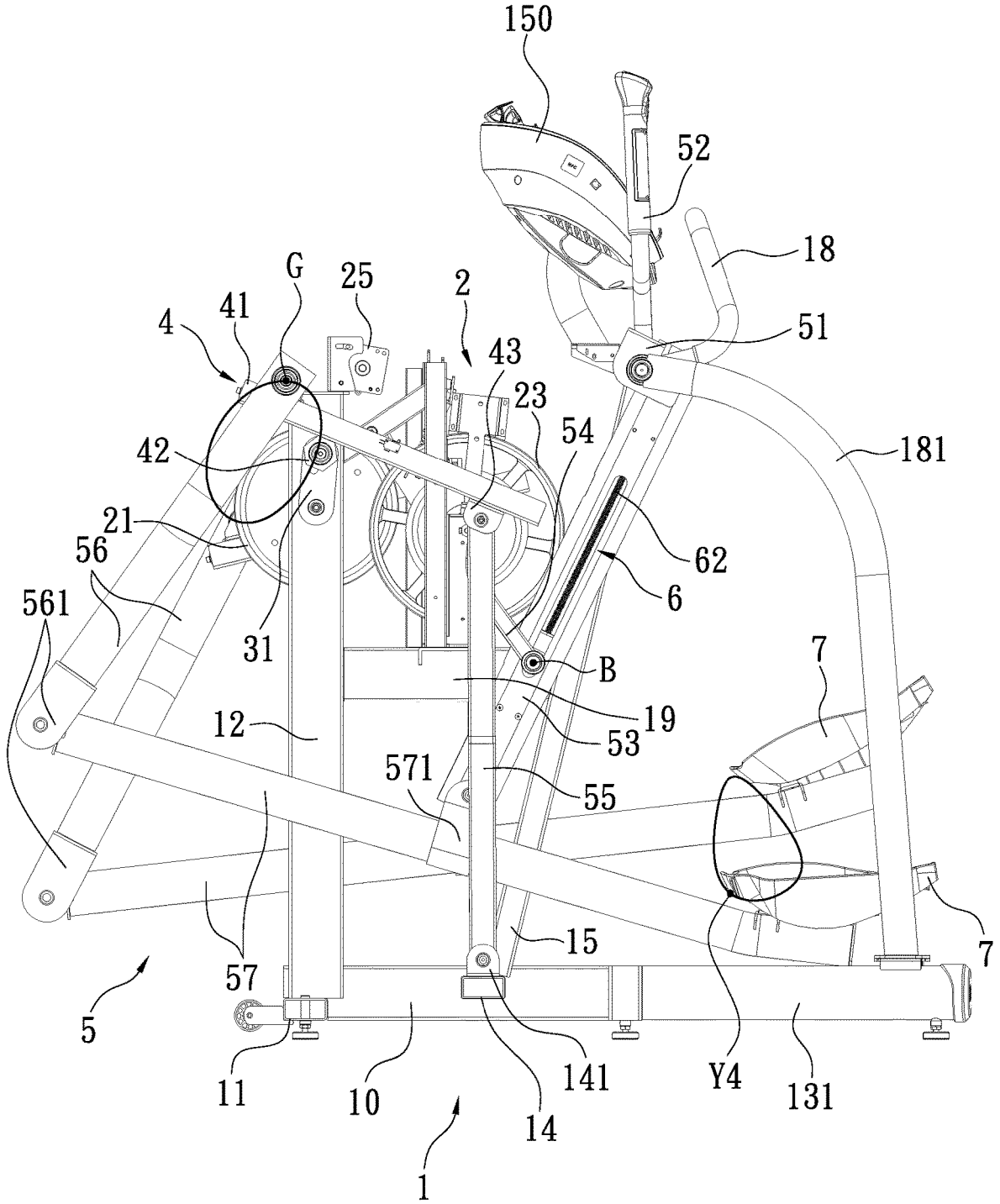
FIG. 13 shows a schematic view of the exercise machine, wherein the pedal can be moved along a trajectory by adjusting the raising/lowering block to a lowest postion and adjusting the displacement block to a frontmost position.
Figure 14:
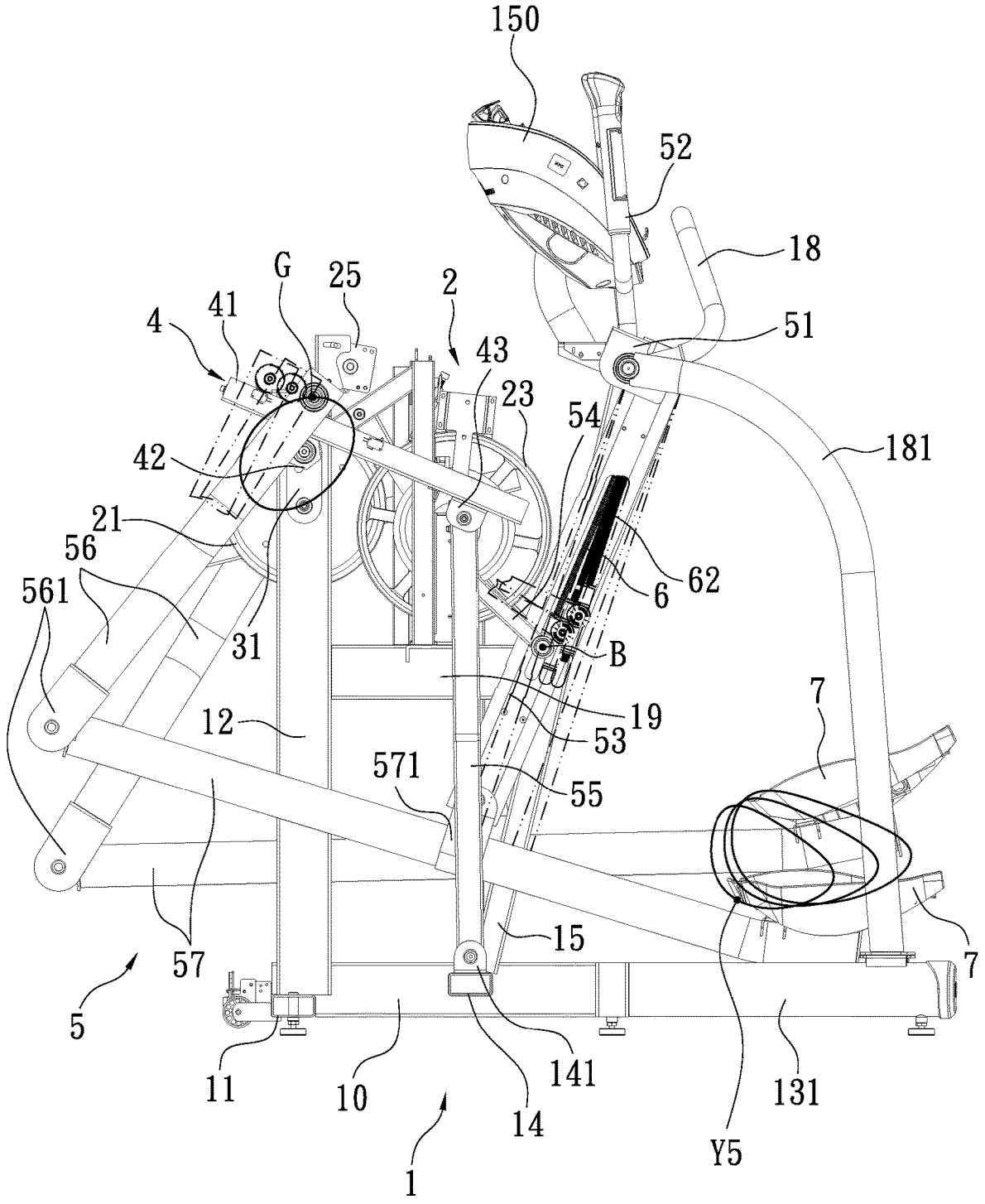
FIG. 14 shows a schematic view of the exercise machine, wherein the pedal can be moved along a trajectory by depressing a bike movement key on the control panel.

Referring to FIGS. 10 and 11, when point (B) of the raising/lowering block 63 is moved to a highest position, the trajectory (Y) performed by each pedal 7 requires a user to take a big step and a big treading force. The trajectory, which is a substantially elliptical closed path, can be finely adjusted by the crank connecting rod assembly 4. When point (G) is adjusted to the rearmost position, as shown in FIG. 10, each pedal 7 performs an elliptical closed path (Y1). When point (G) is adjusted to the frontmost position, as shown in FIG. 11, each pedal 7 performs an elliptical closed path (Y2), which has a minor axis greater than the elliptical path (Y1) shown in FIG. 10. When point (B) of the raising/lowering block 63 is moved to a lowest position, as shown in FIGS. 12 and 13, the trajectory performed by each pedal 7 is an elliptical closed path which is tilted up at its front and requires a user to take a small step. This trajectory allows a user to feel like climbing a flight of steps, and thus is termed as a stepper movement path. The trajectory can be finely adjusted by the crank connecting rod assembly 4. When point (G) is adjusted to the rearmost position, as shown in FIG. 12, each pedal 7 performs an elliptical closed path (Y3). When point (G) is adjusted to the frontmost position, as shown in FIG. 13, each pedal 7 performs an elliptical closed path (Y4), which has a minor axis greater than the elliptical path (Y3) as shown in FIG. 12.

Referring to FIG. 7, when a user depresses the elliptical movement key 153 on the control panel 150, point (B) of the raising/lowering block 63 can be moved to a highest position such that each pedal 7 can perform an elliptical closed path (Y1, Y2) (see FIGS. 10 and 11), which requires the user to take a big step and a big stepping force. Under this position of point (B), the exercise machine performs an elliptical movement mode for a user. Furthermore, one adjustement key 154 on the control panel 150 allows point (G) located at the pivot pin 45 of each crank connecting rod assembly 4 to be moved along the hollow link body 41, so that the minor axis of the elliptical path can be adjusted.

Referring again to FIG. 7, when a user depresses the stepper movement key 151 on the control panel 150, point (B) of the raising/lowering block 63 can be moved to a lowest postion such that each pedal 7 can perform an elliptical closed path (Y3, Y4) (see FIGS. 12 and 13), which is tilted up at its front and requires the user to take a small step. Under this position of point (B), the exercise machine performs a stepper movement mode. Furthermore, one adjustement key 154 on the control panel 150 allows point (G) located at the pivot pin 45 of each crank connecting rod assembly 4 to be moved along the hollow link body 41, so that the minor axis of the tilted elliptical path can be changed.

Referring again to FIG. 7, when a user depresses the bike movement key 152 on the control panel 150, each pedal 7 can be moved along an elliptical closed path (see FIG. 14). wherein the length of the major axis is different from that of the minor axis, but the ratio of the minor axis to the major axis is greater than that of the previous modes. By depressing the bike movement key 152, the exercise machine performs a bike movement mode, which allows the user to feel like riding on a bicycle. Furthermore, one fine adjustment key 154 one the control panel 150 can be used to simultaneously move the displacement block 443, indicated by point (G), and the raising/lowering block 63, indicated by point (B) to adjust the length of the major axis and the length of the minor axis, wherein the length of the major axis is different from the length of the minor axis.

Figure 15:
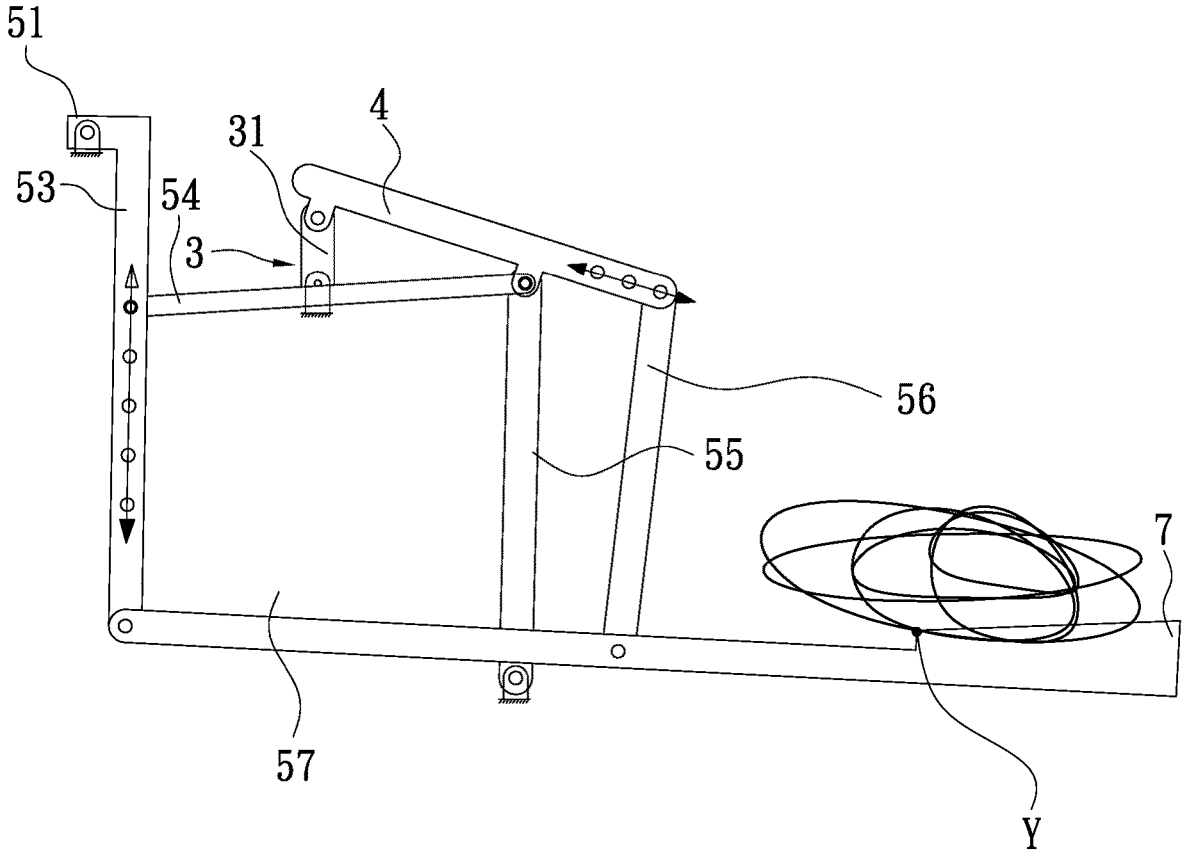
FIG. 15 shows another embodiment of the exercise machine of the present invention.

FIG. 15 shows another embodiment of an exercise machine of the present invention, which generally comprises a base frame (not shown), a transmission unit (not shown), a crank assembly 3, a pair of crank connecting rod assemblies 4, a pair of linkage units, and a control panel (not shown), wherein the base frame, the transmission unit, and the control panel are omitted because they are similar to those of the previous embodiment. The transmission unit, similar to the previous embodiment, is installed on the base frame and includes a first wheel mounted at the base frame, and an electrical generator driven by the first wheel. The crank assembly 3, similar to the previous embodiment, includes a central axle fixed at a center of the first wheel and extends through the base frame to have the first wheel rotatably mounted at the base frame, wherein a left crank arm is fixed to one end of the central axle; a right crank arm is fixed to another end of the central axle and extends in a direction opposite to the left crank arm. Each of the linkage units includes a hollow adjustment link 53 provided with a pivot portion 51 at a top thereof, a lateral link 56, a lower link 57 provided with a pedal 7 at a rear end thereof, a substantially vertical link 55, and an upper link 54. The hollow adjustment link 53 includes therein a raising/lower device (not shown) for moving a raising/lowering block (not shown) which is pivotally connected to one end of the upper link 54. A bottom of the substantially vertical link 55 is pivotally connected to a fixed pivot portion of the base frame. The pivot portion 51 of the hollow adjustment link 53 is pivotally connected to the base frame. The lower link 57 is provided with a pivot portion for being pivotally connected to a bottom of the lateral link 56. A bottom of the hollow adjustment link 53 is pivotally connected to a front end of the lower link 57. Each of the crank connecting rod assemblies 4 includes a hollow link body (not labeled) having a front pivot portion (not labeled) and a rear pivot portion (not labeled), a displacing device (not shown), and a displacement block (not shown) driven by the displacing device and provided with a pivot pin (not labeled) that is pivotally connected to a top of the lateral link 56. The front pivot portion of each crank connecting rod assembly 4 is pivotally connected with one end of one of the left and righ crank arms 31. The rear pivot of each crank connecting rod assembly 4 is pivotally connected to another end of upper link 54 and a top of the substantially vertical link 55. The pedal 7 of this embodiment can also perform a plurality of elliptical closed paths (Y), which are ergonomical so that users can be protected from exercise injury.

As a summary, the exercise machine of the present invention allows a user to change the configuration of linkage units 5 through the control panel 150 so as to select a desired movement or exercise mode, which allows each pedal 7 to perform a closed path, which is ergonomical so that the user can be protected from exercise injury.

I claim:

1. A composite motion exercise machine, which comprises a base frame, a transmission unit, a crank assembly, a pair of crank connecting rod assemblies, a pair of linkage units, and a control panel; wherein the base frame allows the exercise machine to be properly placed on a floor; the transmission unit includes a first wheel mounted at the base frame; the crank assembly includes a central axle fixed at a center of the first wheel and extending through the base frame to have the first wheel rotatably mounted at the base frame; each of said linkage units is located respectively at two sides of a vertical axis (V) extending along a front upright bar of said base frame; each of said linkage units is located respectively at two sides of a vertical axis (X) passing through a corresponding fixed pivot portion of a middle transverse bar of said base frame; said linkage units, each including a plurality of links, wherein each linkage unit is provided with a pedal capable of being treaded by a user to move along a closed path; the control panel can be operated by the user to change configuration of the linkage units so that the exersise machine provides a plurality of movement modes to be selected by the user.

2. The composite motion exercise machine of claim 1, which further comprises an electrical generator mounted at the base frame and driven by the first wheel; a left crank arm fixed to one end of the central axle, and a right crank arm fixed to another end of the central axle and extending in a direction opposite to the left crank arm; each of the linkage units includes a hollow adjustment link provided with a pivot portion at a top thereof, a lateral link, a lower link provided with the pedal at a rear end thereof, a substantially vertical link, and an upper link, the hollow adjustment link including therein a raising/lowering device for moving a raising/lowering block which is pivotally connected at a point B to one end of the upper link, a bottom of the substantially vertical link pivotally connected to a fixed pivot portion of the middle transverse bar, the pivot portion of the hollow adjustment link pivotally connected to the base frame, the lower link provided with a pivot portion at a middle thereof for being pivotally connected to a bottom of the hollow adjustment link, a bottom of the lateral link pivotally connected to a front end of the lower link; each of the crank connecting rod assemblies includes a hollow link body having a front pivot portion and a rear pivot portion, a displacing device, and a displacement block driven by the displacing device and pivotally connected at a point (G) to a top of the lateral link and is capable of moving along a generally elliptical path, the front pivot portion of each crank connecting rod assembly pivotally connected to one end of one of the left and righ crank arms, the rear pivot of each crank connecting rod assembly pivotally connected to another end of the upper link and a top of the substantially vertical link.

3. The composite motion exercise machine of claim 2, wherein the base frame includes a main longituindal bar, a front transverse bar at a front end of the main longitudinal bar, a rear transverse bar at a rear end of the main longituidinal bar, a middle transverse bar at a middle portion of the main longituidnal bar, a front upright bar extending upwardly from an intersection of the main longitudinal bar and the front transverse bar, a left side bar extending rearwardly from one end of the rear transverse bar, a right side bar extending rearwardly from another end of the rear transverse bar, and a rear upright bar extending upwardly from an intersection of the main longitudinal bar and the middle transvers bar, the control panel being located at a top of the rear upright bar and containing an elliptical movement key, a stepper movement key, and a bike movement key, and a plurality of fine adjustment keys, the rear upright bar provided with a left shaft and a right shaft at a location below the control panel, a handle bar fixed between the left and right shafts, a left guard rail provided between the left shaft and the left side bar, a left guard rail provided between the right shaft and the right side bar, a horizontal connection bar provided between the front upright bar and the rear upright bar, an upright brace extending upwardly from the horizontal connection bar.

4. The composite motion exercise machine of claim 3, wherein the transmission unit further includes a second wheel made of cast steel, a first belt, a second belt, and an idler set, the second wheel being mounted at the upright brace provided at the horizontal connection bar, the first belt being disposed around the first wheel and a pulley mounted coaxially with the second wheel, the second belt being disposed around another pulley mounted coaxially with the second wheel and a pulley mounted at an driven axle of the electrical generator so that the first wheel can rotate the second wheel which in turn rotate the electrical generator to generate electricity, the idler set being forced to contact the first belt to absrob vibrational energy so that nosie level can be reduced and the life span of the exercise machine can be increased.

5. The composite motion exercise machine of claim 2, wherein the crank assembly further includes a left crank pin and a right crank pin, the left crank pin being located at one end of the left crank arm distal from the central axle, the right crank pin being located at one end of the right crank arm distal from the central axle; the front pivot portion of each crank conneting rod assembly is pivotally connected with one of the left and right crank pins.

6. The composite motion exercise machine of claim 2, wherein the displacing device includes a motor and a threaded rod driven by the motor and being in threaded engagement with the displacement block, whereby the motor can move the displacement block along the hollow link body, thus changing the position of the point (G).

7. The composite motion exercise machine of claim 3, wherein the pivot portion of the hollow adjustment link of each linkage unit is pivotally connected to one of the left and right shaft provided at the rear upright bar of the base frame; each of the linkage unit further includes a grip bar provided at the pivot portion of the corresponding hollow adjustment link; the lateral link is provided with a pivot portion at a bottom thereof for being pivotally connected to the front end of the lower link.

8. The composite motion exercise machine of claim 7, wherein the pivot portion of the lateral link and the bottom of the hollow adjustment link of each linkage unit are located respectively at two sides of the vertical axis (V) extending along the front upright bar; the pivot portion of the lateral link and the pedal of each linkage unit are located respectively at two sides of the vertical axis (X) passing through the corresponding fixed pivot portion of the middle transverse bar.

9. The composite motion exercise machine of claim 7, wherein when depressing the elliptical movement key, the raising/lowering block is moved up to a highest postion such that the pedal is moved along an approximately elliptical closed path, which has a minor axis capable of being adjusted by depressing one of the fine adjustment keys to move the displacement block; when the stepper movement key is depressed, the raising/lowering block is moved down to a lowest postion such that the pedal is moved along an approximately elliptical closed path, which is tilted up at a front portion thereof and has a major axis smaller than an elliptical path caused by depressing the elliptical movement key and which has a minor axis capable of being adjusted by depresing one of the fine adjustment keys to move the displacement block; when the bike movement key is depressed, the pedal is moved along an approximately elliptical closed path which has approximately equal major and minor axes, each of which is adjustable by depressing one of the fine adjustment keys to simultaneously move the displacement block and the raising/lowering block.

10. The composite motion exercise machine of claim 1, which further comprises a base frame, a transmission unit, a crank assembly, and a pair of crank connecting rod assemblies; wherein the base frame allows the exercise machine to be properly placed on a floor; the transmission unit is installed on the base frame and includes a first wheel mounted at the base frame, and an electrical generator driven by the first wheel; the crank assembly includes a central axle fixed at a center of the first wheel and extending through the base frame to have the first wheel rotatably mounted at the base frame, a left crank arm being fixed to one end of the central axle, a right crank arm being fixed to another end of the central axle and extending in a direction opposite to the left crank arm; each of the linkage units includes a hollow adjustment link provided with a pivot portion at a top thereof, a lateral link, a lower link provided with the pedal at a rear end thereof, a substantially vertical link, and an upper link, the hollow adjustment link including therein a raising/lower device for moving a raising/lowering block which is pivotally connected to one end of the upper link, a bottom of the substantially vertical link being pivotally connected to a fixed pivot portion of the rear transverse bar, the pivot portion of the hollow adjustment link pivotally connected to the base frame, the lower link being provided with a pivot portion for being pivotally connected to a bottom of the lateral link, a bottom of the hollow adjustment link being pivotally connected to a front end of the lower link; each of the crank connecting rod assemblies includes a hollow link body having a front pivot portion and a rear pivot portion, a displacing device, and a displacement block driven by the displacing device and provided with a pivot pin that is pivotally connected to a top of the lateral link, the front pivot portion of each crank connecting rod assembly being pivotally connected with one end of one of the left and righ crank arms, the rear pivot of each crank connecting rod assembly being pivotally connected to another end of upper link and a top of the substantially vertical link.

11. The composite motion exercise machine of claim 9, wherein various closed paths can be obtained for each pedal by moving the raising/lowering block along the hollow adjustment link to change the position of the point (B) and/or moving the displacement block along the crank connecting rod assembly to change the position of the point (G), wherein each closed path has a major axis of a specific length and a minor axis of a specific length.

* * * * *